US011808551B2

(12) United States Patent
Peterson

(10) Patent No.: US 11,808,551 B2
(45) Date of Patent: Nov. 7, 2023

(54) CARTRIDGE WITH IMPROVED PENETRATION AND EXPANSION BULLET

(71) Applicant: FEDERAL CARTRIDGE COMPANY, Anoka, MN (US)

(72) Inventor: Bryan P. Peterson, Isanti, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 17/752,540

(22) Filed: May 24, 2022

(65) Prior Publication Data

US 2022/0349689 A1 Nov. 3, 2022

Related U.S. Application Data

(63) Continuation of application No. 17/173,778, filed on Feb. 11, 2021, now Pat. No. 11,346,641, which is a (Continued)

(51) Int. Cl.
*F42B 12/08* (2006.01)
*F42B 12/78* (2006.01)
(Continued)

(52) U.S. Cl.
CPC ..... *F42B 12/08* (2013.01); *F42B 5/02* (2013.01); *F42B 5/025* (2013.01); *F42B 12/34* (2013.01);
(Continued)

(58) Field of Classification Search
CPC ..... F42B 12/08; F42B 12/34; F42B 12/74; F42B 12/78; F42B 30/02; F42B 33/00; F42B 5/02; F42B 5/025
(Continued)

(56) References Cited

U.S. PATENT DOCUMENTS 682,364 A 9/1901 Mangon
1,903,657 A * 4/1933 Reed ..... F42B 5/02 102/430
(Continued)

FOREIGN PATENT DOCUMENTS

CA 2940332 9/2015
DE 9301706 U1 6/1993
(Continued)

OTHER PUBLICATIONS

"Russian Handgun Ammo With Steel Forward Portion" downloaded from the internet at: https://www.ar15.com/forums/general Why_not_make_some_legal_handgun_AP_to_get_the_BATFE_back_for_7N6_and_M855_UPDATE_with_380_on_pg_5/5-1721610/&page=3 (8 pgs.).
(Continued)

*Primary Examiner* — Samir Abdosh
(74) *Attorney, Agent, or Firm* — Reed Smith LLP; Matthew P. Frederick; Travis J. Sumpter

(57) ABSTRACT

A cartridge with a bullet has desirable penetration capabilities and controlled separation of components upon terminal impact. In embodiments of the invention, the bullet comprises a forward component, a lead core, and a copper jacket. The bullet having a forward nose portion with a plurality of cutaways spaced circumferentially about the nose portion. The copper jacket having a leading edge portion positioned at the cutaways.

20 Claims, 10 Drawing Sheets

Related U.S. Application Data continuation of application No. 16/685,413, filed on Nov. 15, 2019, now Pat. No. 10,928,170, which is a continuation of application No. 15/866,153, filed on Jan. 9, 2018, now Pat. No. 10,520,288, which is a continuation of application No. 15/219,012, filed on Jul. 25, 2016, now Pat. No. 9,863,746.

(60) Provisional application No. 62/217,533, filed on Sep. 11, 2015, provisional application No. 62/205,786, filed on Aug. 17, 2015.

(51) Int. Cl.

| | |
|---|---|
| ***F42B 30/02*** | (2006.01) |
| ***F42B 33/00*** | (2006.01) |
| ***F42B 5/02*** | (2006.01) |
| ***F42B 12/34*** | (2006.01) |
| ***F42B 12/74*** | (2006.01) |

(52) U.S. Cl.
CPC ..... *F42B 12/74* (2013.01); *F42B 12/78* (2013.01); *F42B 30/02* (2013.01); *F42B 33/00* (2013.01)

(58) Field of Classification Search
USPC ..... 102/438, 439
See application file for complete search history.

(56) References Cited

U.S. PATENT DOCUMENTS

| | | | | | |
|---|---|---|---|---|---|
| 2,045,964 | A * | 6/1936 | Rinkel | F42B 12/34 | 86/19.6 |
| 2,958,287 | A * | 11/1960 | Auxier | F42B 12/78 | 102/507 |
| 3,142,256 | A * | 7/1964 | Bernhard, V | F42B 12/78 | 102/508 |
| 3,756,158 | A * | 9/1973 | Anderson | F42B 12/78 | 102/507 |
| 4,644,866 | A * | 2/1987 | Sullivan | F42B 7/10 | 102/501 |
| 5,094,169 | A | 3/1992 | Evitts | | |
| 5,259,320 | A * | 11/1993 | Brooks | B21K 21/06 | 102/501 |
| 5,811,723 | A * | 9/1998 | Stone | F42B 12/34 | 102/509 |
| 5,943,749 | A * | 8/1999 | Swank | F42B 12/34 | 102/509 |
| 6,439,125 | B1 * | 8/2002 | Carter | F42B 5/025 | 102/524 |
| 6,837,165 | B2 * | 1/2005 | Eberhart | F42B 12/74 | 73/12.05 |
| 6,862,993 | B1 * | 3/2005 | Cudazzo | F42B 5/26 | 102/464 |
| 6,971,315 | B2 * | 12/2005 | Knappworst | F42B 12/34 | 102/508 |
| 9,797,696 | B2 * | 10/2017 | Golloher | F42B 12/34 | |
| 2003/0209164 | A1 | 11/2003 | Pi | | |
| 2005/0126422 | A1 * | 6/2005 | Lamm | F42B 8/12 | 102/508 |
| 2006/0278117 | A1 | 12/2006 | Emary | | |
| 2008/0156222 | A1 | 7/2008 | Orlanov | | |
| 2014/0326157 | A1 * | 11/2014 | Conroy | F42B 12/74 | 102/514 |
| 2014/0326158 | A1 * | 11/2014 | Fritz | F42B 12/02 | 102/524 |
| 2015/0083011 | A1 * | 3/2015 | Emary | F42B 12/24 | 102/506 |
| 2018/0364017 | A1 * | 12/2018 | Peterson | F42B 14/02 | |

FOREIGN PATENT DOCUMENTS

| | | |
|---|---|---|
| RU | 2413 169 C1 | 2/2011 |
| WO | WO2004/085953 | 10/2004 |
| WO | WO2017015665 | 1/2017 |

OTHER PUBLICATIONS

Supplemental European Search Report for Application No. EP 16 82 8688 dated Jan. 21, 2019.

* cited by examiner

CARTRIDGE WITH IMPROVED PENETRATION AND EXPANSION BULLET

CROSS-REFERENCE TO RELATED APPLICATIONS

The present application is a continuation of U.S. patent application Ser. No. 17/173,778, filed on Feb. 11, 2021, which is a continuation of U.S. patent application Ser. No. 16/685,413, filed on Nov. 15, 2019, which is a continuation of U.S. patent application Ser. No. 15/866,153, filed on Jan. 9, 2018, now U.S. Pat. No. 10,520,288, which is a continuation of U.S. patent application Ser. No. 15/219,012, filed on Jul. 25, 2016, now U.S. Pat. No. 9,863,746, which claims priority to U.S. Provisional Application No. 62/196,217 filed on Jul. 23, 2015, U.S. Provisional Application No. 62/217,533 filed on Sep. 11, 2015, and U.S. Provisional Application No. 62/250,786 filed on Nov. 4, 2015; all of which are incorporated by reference herein in their entirety.

FIELD OF THE INVENTION

The present invention is generally relates to cartridges for use with handguns. More particularly, to a cartridge comprising a case with a jacketed bullet with a forward component and a core component.

SUMMARY OF THE INVENTION

A cartridge with an improved bullet has desirable penetration capabilities and controlled separation of components upon terminal impact. In embodiments of the invention, the bullet comprises a forward component, a lead core behind it, and a copper jacket. The forward component having a nose portion, a cylindrical mid portion, a rearward body portion that tapers forwardly. The copper jacket encompasses the lead core and extends forward to the cylindrical mid portion of the steel component and terminates at a leading edge portion.

In embodiments of the invention, the bullet comprises a forward component formed of steel, and a copper core integral or unitary with a copper jacket.

A feature and advantage of embodiments is that the forward steel component may be formed with a spin inhibiting feature in the rearwardly facing end surface of the steel forward component. The feature may be protruding or recessed structure that conforms the lead or copper core during assembly to an inverse of such shape providing a locking feature between the core and the steel forward component. The feature on the rearward end may be a projection or an indentation, a plurality of such, or both, on the rearward facing surface of the steel component.

A feature and advantage of embodiments of the invention is that a concavity in the end of the jacket provides enhanced and more stable obturation of the projectile with the barrel resulting in increased accuracy. The concavity allows the propellant expansion to impart a radial force component acting on the rearward end of the projectile to deform the rearward end of the projectile outwardly providing more consistent engagement of the jacket with the barrel along the length of the projectile. Moreover, the rearwardly facing end of the jacket with the concavity provides an increased radial deformation capability compared to a flat end facilitating the radial expansion of the casing facilitating the sealing with the gun barrel.

The concavity allows the projectile to be slightly longer with the same weight, and providing the same propellant load. This is believed to improve accuracy as longer bullets are understood to generally enhance accuracy.

A feature and advantage of embodiments of the invention is that the steel component has a forward ogive portion, a unitary cylindrical mid portion, and a unitary rearward portion that increases in diameter rearwardly from the cylindrical mid portion. In embodiments, the rearward portion tapers forwardly and has an abbreviated rearward cylindrical end portion and a rounded end corner. Adjacent the rear end corner is the maximum diameter portion of the steel component; the maximum diameter dimension extends for a minimal axial distance, in embodiments less than 20% of the axial length of the forward component. In embodiments, the maximum diameter portion extends less than 15% of the length of the bullet. In embodiments, the maximum diameter portion extends less than 10% of the length of the bullet. The relative short full diameter portion is believed to keep barrel forces low, such as bullet to barrel friction, potentially reducing barrel wear.

A feature and advantage of embodiments of the invention is that the jacket forward edge or lip engages the cylindrical mid portion, allowing an axial extending range on the cylindrical mid portion where the jacket edge may engage providing flexibility and an increased tolerance during manufacturing for the positioning of the forward edge of the jacket.

A feature and advantage of embodiments is that the forward edge of the jacket has a reverse taper, opposite to that of the overall taper of the projectile. This reverse taper positioned at a cylindrical mid portion of forward component, presents a forward facing circumferential scoop which has minimal or no effect on flight characteristics but facilitates the initiation of the outward expansion of the jacket on impact with a fluidic target. This further facilitates the stripping-off of the jacket from the steel component providing advantageous terminal effects such as fragmentation of the projectile and faster yawing. Both are associated with increased stopping power. A further feature and advantage of embodiments is that a forward tapered portion of the jacket may have axially extending skives that may facilitate opening of the jacket upon impact.

A feature and advantage of embodiments is that the forward component is retained in the jacket forward of the lead core, the forward component having a forward ogive portion, a cylindrical mid portion adjoined to and unitary with the forward ogive portion, and a rearward portion adjoined to and unitary with the cylindrical mid portion, the entirety of the rearward portion diametrically larger than the cylindrical mid portion, the entirety of the cylindrical mid portion diametrically larger than the forward ogive portion, A feature and advantage of embodiments of the invention is that the forward ogived portion and mid portion of the steel component may have forward and outwardly facing cut-outs or divots that provide for a greater forward facing scooping area further enhancing the initiation of the opening of the jacket, the opening of the jacket, and the stripping off of the jacket from the steel component. The circumferentially arranged divots provide increased terminal performance while maintaining reliability of weapon system because the external profile of projectile is left unchanged, for example, the feed ramp for the cartridges is not impacted by the circumferential divots.

A feature and advantage of embodiments is that a forward steel portion may be used essentially as a punch to conform a ball shaped lead portion to conform to the jacket and the rearward facing surface of the forward component.

DETAILED DESCRIPTION

Figure 1A:
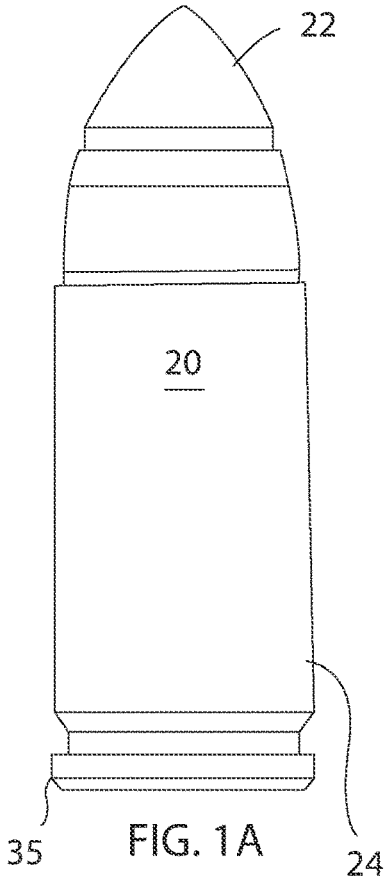
FIG. 1A is a front elevational view of a cartridge according to embodiments of the invention.
Figure 1B:
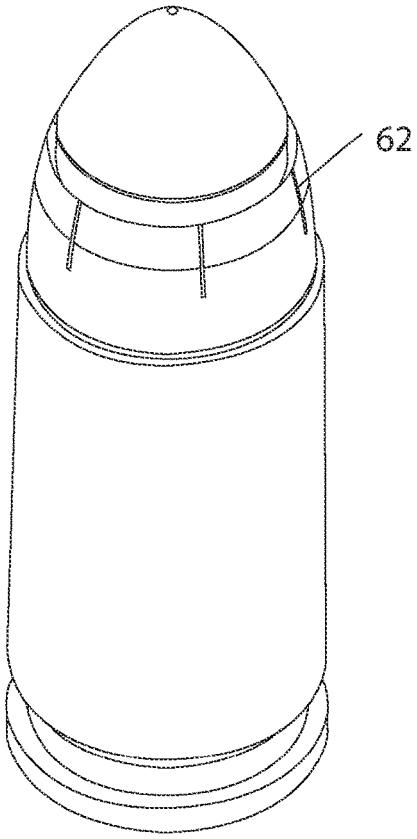
FIG. 1B is a front perspective view of a cartridge according to embodiments of the invention.
Figure 1C:
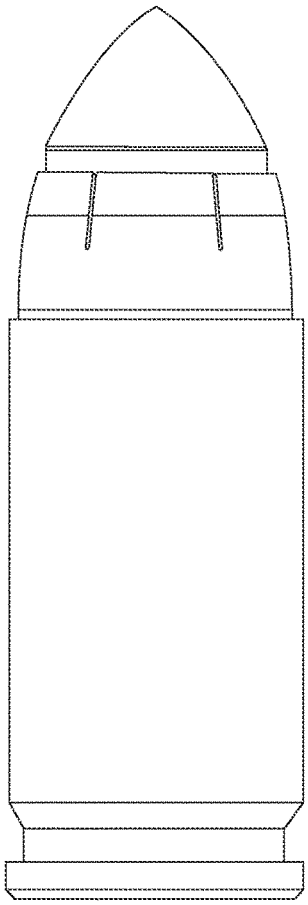
FIG. 1C is a front elevational view of the cartridge of FIG. 2.
Figure 2:
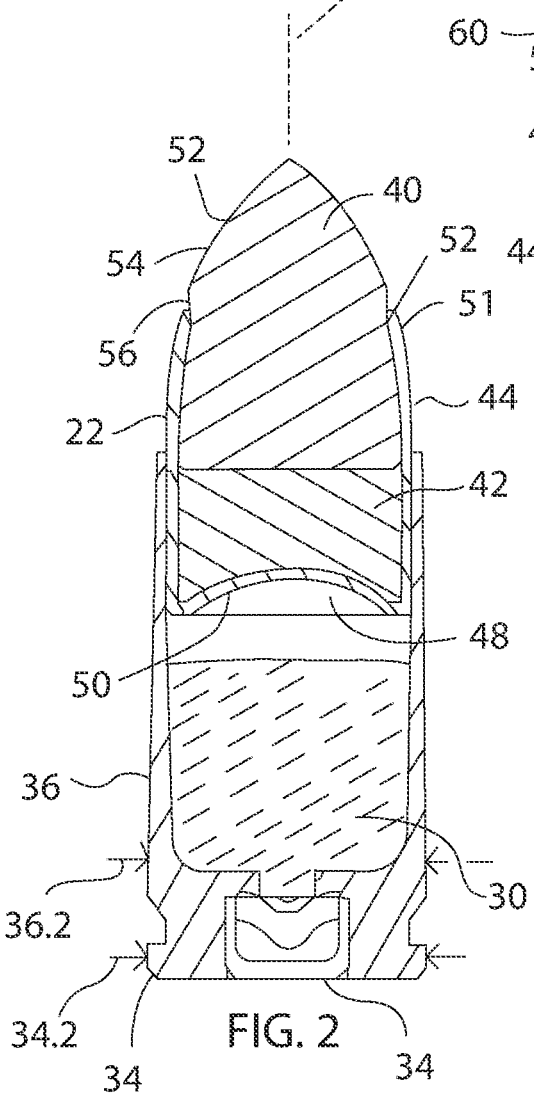
FIG. 2 is a cross-sectional view of the cartridge of FIG. 1.
Figure 3:
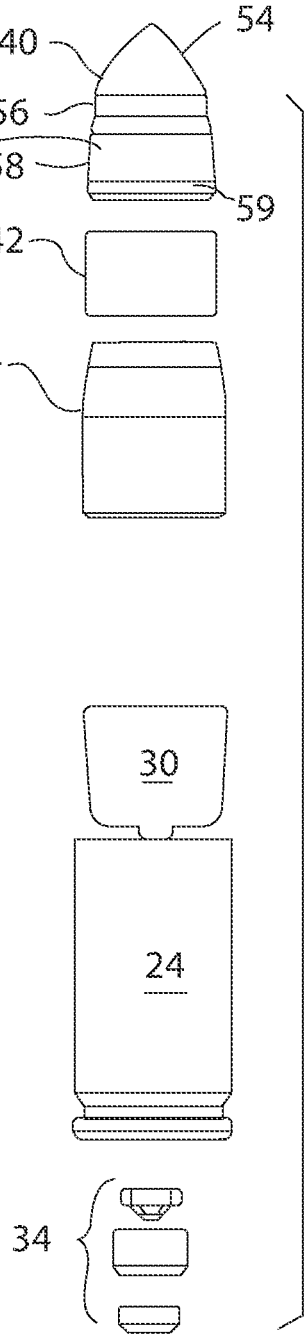
FIG. 3 is an exploded view of the cartridge of FIGS. 1 and 2.

Referring to FIGS. 1A-2, a handgun cartridge 20, for example a 9 mm cartridge, has a bullet 22, a casing 24, propellant 30, and a primer assembly 34. The casing 24 has a rim 35 with a diameter 35.2 and a wall portion 36 having a diameter 36.2. In embodiments, the rim diameter is the same as the wall portion diameter. The bullet is comprised of a forward component 40, a core component 42, and a jacket 44. The forward component may be formed of steel but other materials are also suitable in particular embodiments. The jacket may comprise copper and the core may comprise lead. In embodiments the core can also be copper and may be unitary with the jacket. In the embodiment of FIG. 2, the bullet is illustrated with a concavity 48 in the rearward facing end 50 of the bullet and in jacket. In other embodiments, the rearward facing end of the bullet may be flat or have other shapes.

Referring to 2, 5A-6E, and 8, the jacket has a leading edge portion 51, a leading edge 52, and a reverse tapered surface 52.2 that may be a frustoconical concave surface. In embodiments, the leading edge is separated from the steel component such that a recess 53, in embodiments a V-shaped recess, in cross-section, faces forward defining a circumferential scoop. One leg of the V is directly in line with the axis 53.3 of the bullet as well as the trajectory path. The V-shaped recess promotes opening of the jacket when the bullet impacts fluidic material which then urges the jacket to open, essentially by hydraulic force. The opened jacket can release the steel component and also the lead core increasing the damage imparted to the target.

Referring to FIGS. 2-8, in embodiments, the forward component 40 has a forward ogive portion 54, a cylindrical mid portion 56 adjoining and unitary with the forward ogive portion, a rearward facing end surface 57, and a rearward portion 58 adjoining and unitary with the cylindrical mid portion 56. In embodiments, the rearward portion 58 of the forward component has a maximum diameter portion 59 rearwardly positioned on the rearward portion, the rearward portion then tapers forwardly to adjoin the cylindrical mid portion with a curved taper. In embodiments, the forward ogive portion of the forward component being contiguous, without any intermediate structure, with the mid portion, the mid portion being contiguous, without any intermediate structure, with the rearward portion. The maximum diameter portion may extend axially defining a maximum diameter cylindrical end portion 59.2. The forward component has an axial length l, and the forward ogive portion extends an axial distance of l1, the cylindrical mid portion an axial distance of l2, and the rearward portion extends an axial distance of l3. In embodiments, l1 is 30 to 50% of l. In embodiments, l2 is 5 to 20% of l. In embodiments, l3 is 35 to 55% of l. In embodiments, l1 is 35 to 45% of l. In embodiments, l2 is 10 to 15% of l. In embodiments, l3 is 40 to 50% of l. The cylindrical end portion, in embodiments, extends axially a distance l4 of less than 10% of the axial length l of the steel component. In embodiments, the maximum diameter cylindrical end portion of the forward component extends axially less than 20% of the axial length l of the steel component. In embodiments, the axial length l4 of maximum diameter cylindrical end portion of the forward component extends axially less than 30% of the axial length l of the steel component. In embodiments, the maximum diameter cylindrical end portion 59.2 of the steel component extends axially a distance l4 less than 5% of the axial length l of the steel component. Forward of the maximum diameter portion is a tapering portion 60 that leads to the cylindrical mid portion 56. In embodiments, the tapering portion 60 is a curved taper with a compound radius. As best illustrated in FIG. 7I, the tapering portion may have a first radius of curvature 60.2 with a greater radius positioned rearwardly of a second radius of curvature 60.3 having a second radius, less than the first radius, defining a curve with an increasing taper. The tapering portion 60 of the rearward portion and the cylindrical mid portion defining a radially outwardly facing recess 61.

In embodiments, the forward component is retained in the jacket forward of the lead core, the forward component having a forward ogive portion, a cylindrical mid portion adjoined to the forward ogive portion, and a rearward portion adjoined to the cylindrical mid portion, the entirety of the rearward portion diametrically larger than the cylindrical mid portion, the entirety of the cylindrical mid portion diametrically larger than the forward ogive portion, In embodiments, the diameter of the cylindrical mid portion is 80 percent or greater of the diameter of the maximum diameter portion of the forward component. In embodiments, the diameter of the cylindrical mid portion is 85 percent or greater of the diameter of the maximum diameter portion. In embodiments, the diameter d1 of the cylindrical mid portion is 70 percent or greater of the diameter d of the maximum diameter portion. In embodiments the ratio of the length of the forward component to the diameter of the forward component is in the range of 1.65 to 1.05. In embodiments the ratio of the length of the forward component to the diameter of the forward component is in the range of 1.50 to 1.20. In embodiments the ratio of the length of the forward component to the diameter of the forward component is in the range of 1.32 to 1.40.

In embodiments, the mid portion rather than being cylindrical, may have a slight taper forwardly of, for example, 2 degrees or less, as measured from a line parallel to the axis. In such embodiments, the mid portion is conical. In embodiments the mid portion may be conical with a taper of 5 degrees or less, as measured from a line parallel to the axis. Such conical mid portions may be substituted for all embodiments described or claimed herein.

Referring to FIGS. 1B, 1C, 5B, and 5C, the jacket may have scores or skives 62 extending axially on the forward portion 63 of the jacket. In embodiments, the skives will terminate at a point before where the bullet will engage barrel rifling, before the cylindrical end portion of the bullet. The skives may be cuts extending partially or completely through the jacket, folds in the jacket, indentations in the jacket, or other weakening of the jacket axially to facilitate tearing and opening of the jacket. U.S. Pat. Nos. 6,805,057 and 6,305,292 illustrate such skives and these patents are incorporated herein by reference for all purposes.

Figure 4A:
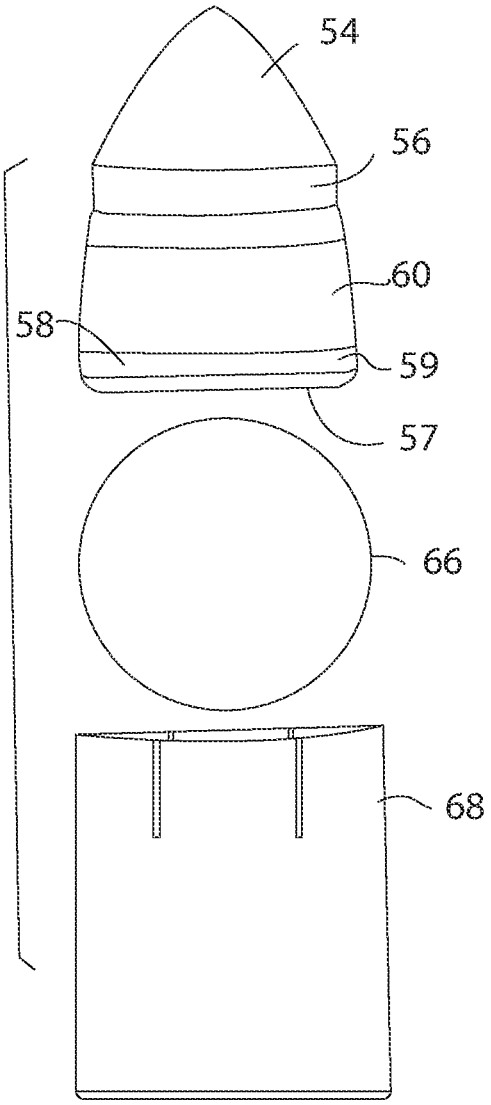
FIG. 4A is an exploded view of components of a bullet prior to assembly according to an embodiment of the invention.
Figure 4B:
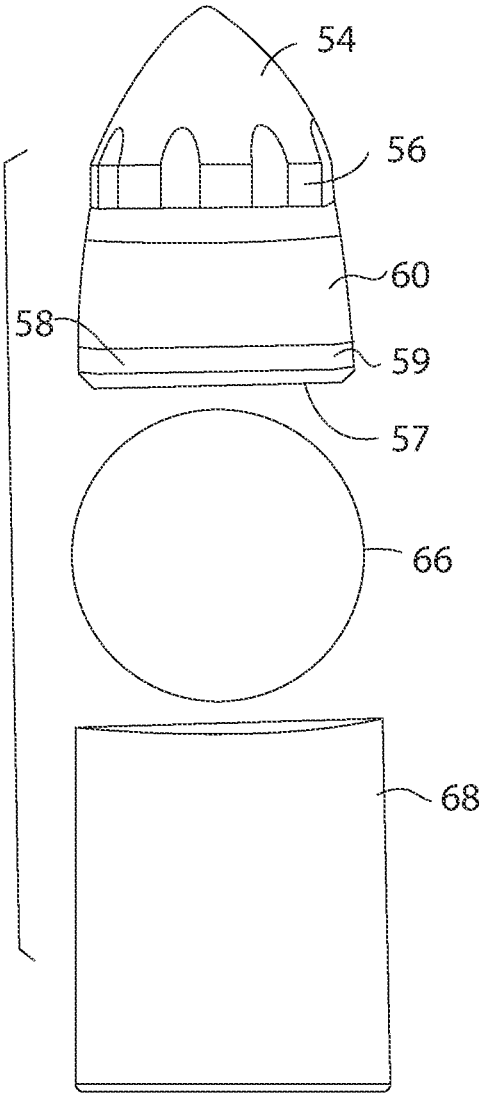
FIG. 4B is an exploded view of components of a bullet prior to assembly according to an embodiment of the invention.
Figure 5A:
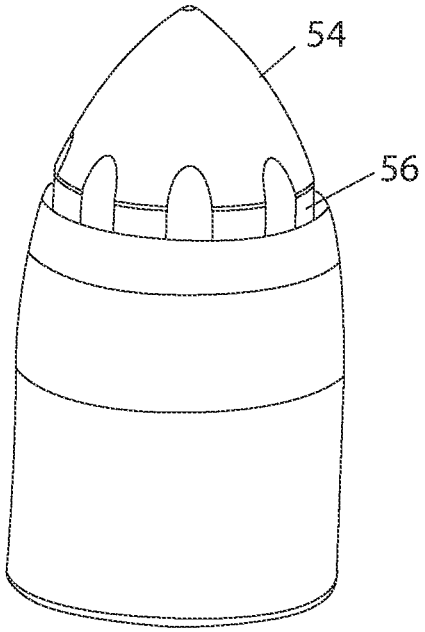
FIG. 5A is a perspective view of a bullet according to embodiments of the invention.
Figure 5B:
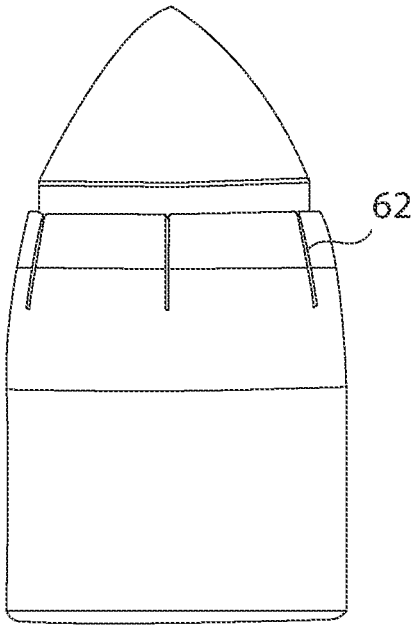
FIG. 5B is a front elevational view of a bullet according to embodiments of the invention.
Figure 5C:
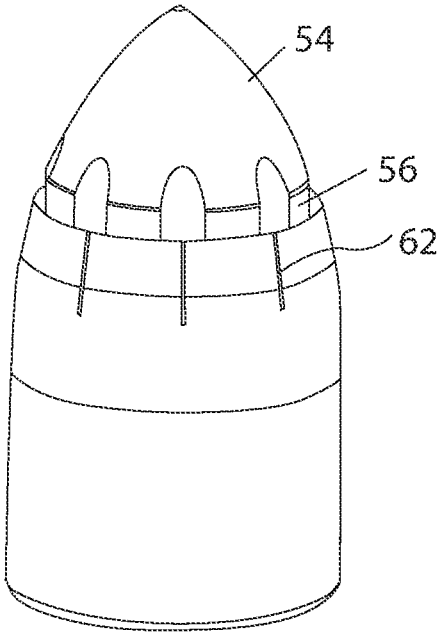
FIG. 5C is a perspective view of a bullet according to embodiments of the invention.

Referring to FIGS. 4B, 5A, 5C, 6A, and 6B, an embodiment of the invention is illustrated. FIG. 4A illustrates the use of a lead ball 66 to provide the lead core and a jacket cup preform 68. The lead ball and jacket are deformed during manufacturing as discussed below. The forward component, which may be steel, has recesses or divots 70 in the cylindrical mid portion 56 and into the ogive portion 54. The recesses or divots increase the forward facing area intermediate the outer surface 74 of the jacket and the forward component thereby increasing the hydraulic force for opening the jacket. FIG. 6 illustrate the V-shaped recess and the enhanced "scoop" areas 77 provided by the divots and the resulting significant increase in hydraulic forces to open the jacket. Thus, embodiments of the invention include circumferentially distributed fluid scoop areas that facilitate jacket pedaling. The fluid scoop area 77 may be defined by the gap or open region between the steel component and the leading edge of the jacket.

Figure 6A:
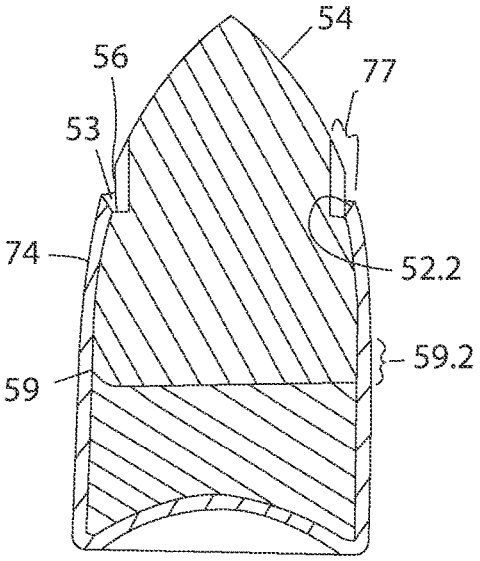
FIG. 6A is a cross-sectional view of the bullet of FIG. 5A.
Figure 6B:
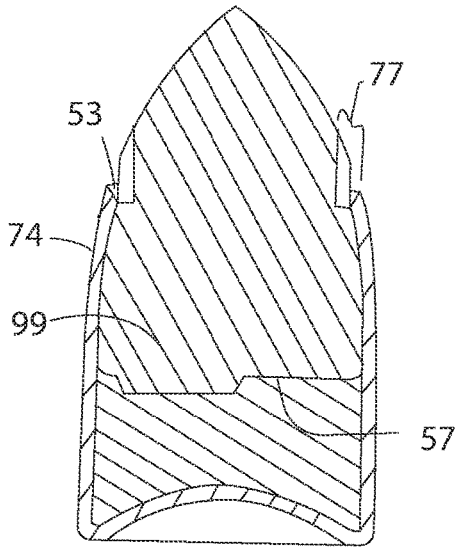
FIG. 6B is a cross-sectional view of the bullet of FIG. 7B.
Figure 6C:
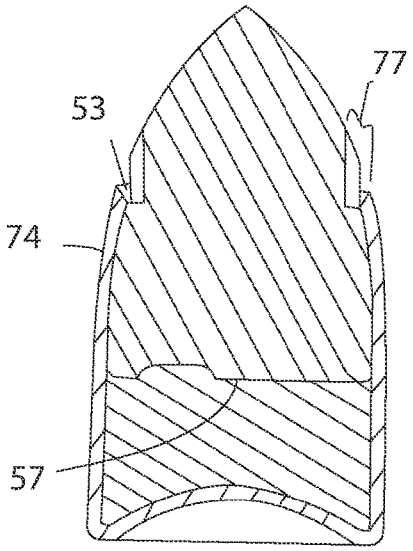
FIG. 6C is a cross-section view of a bullet having a recess in the rearward facing end surface of the forward component.
Figure 6D:
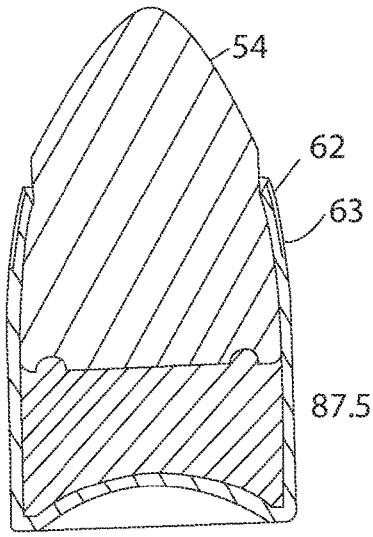
FIG. 6D is a cross-section view of a bullet having a plurality of recesses in the rearward facing end surface of the forward component.
Figure 6E:
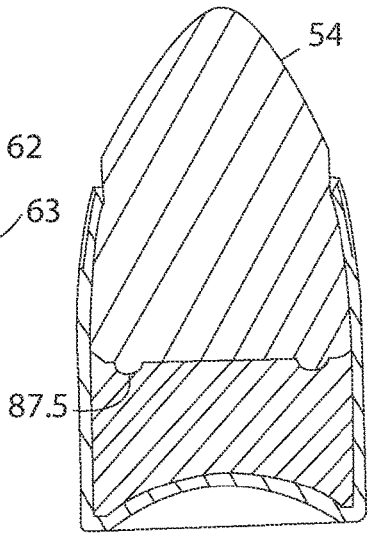
FIG. 6E is a cross-section view of a bullet having a plurality of projections in the rearward facing end surface of the forward component.

Referring to FIGS. 6B-7H, the forward component 40.1, 40.2, 40.3, 40.4, 40.5, 40.6, and 40.7 may have rotation inhibiting features 82, 83, 84 on the rearward facing end surface 57. The rotation inhibiting features may be configured as ribs 86 and project outwardly as shown in FIGS. 7A and 7B. Alternately, the feature may be a recess 87 in the surface as illustrated by FIGS. 7C, 77E, 7F, and 7H. Projections 87.5, such as nubs, partial spheres, or other surface structure may also be utilized to lock the forward steel component, or other material component, to the core. The bullets may be axially stacked during manufacturing processes, and the central pad 88 of FIG. 7D can facilitate such stacking such that the bullets do not misalign. FIG. 6B corresponds to the ribs of FIG. 7A and FIG. 6C corresponds to segmented recess, not shown in perspective. These interface feature will inhibit or prevent the steel component 40 from rotating with respect to the core 42.

Figure 7A:
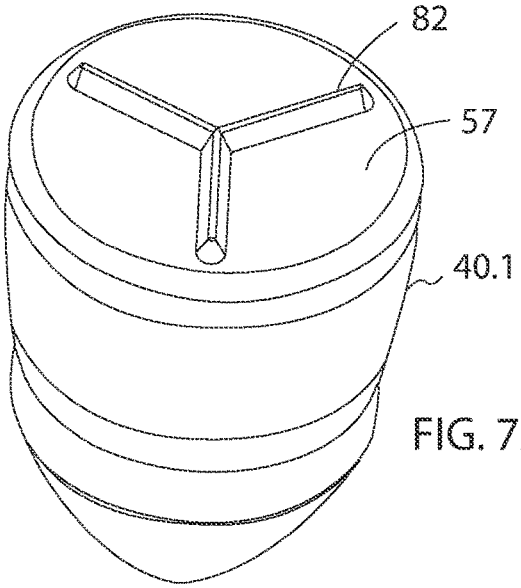
FIG. 7A is a perspective view of a forward component with a non-spin feature on the rearward facing end.
Figure 7D:
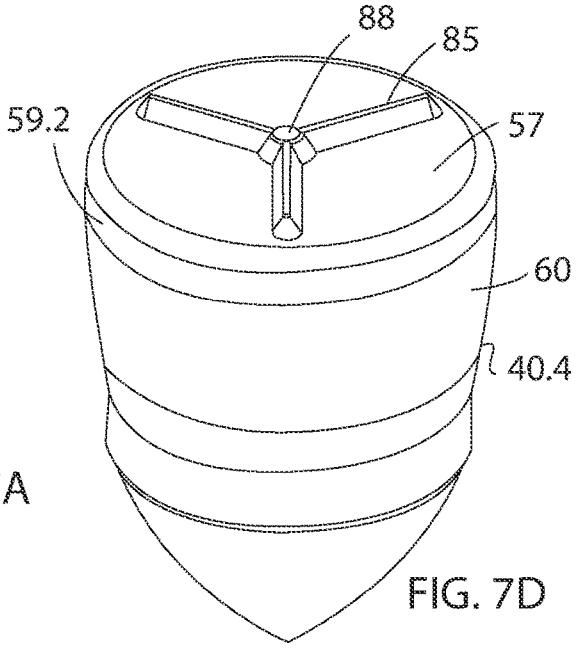
FIG. 7D is a perspective view of a forward component with a non-spin feature on the rearward facing end and a pad for accommodating a tip of an adjacent bullet during manufacturing processes.
Figure 7B:
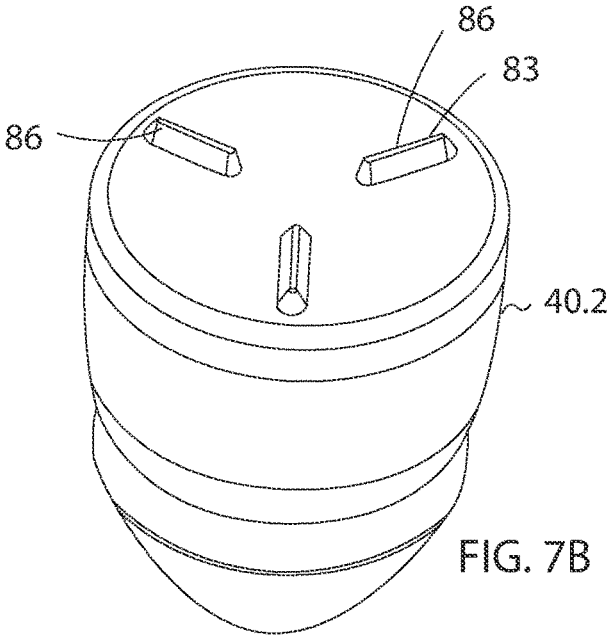
FIG. 7B is a perspective view of a forward component with separate ribs as the non-spin feature on the rearward facing end.
Figure 7C:
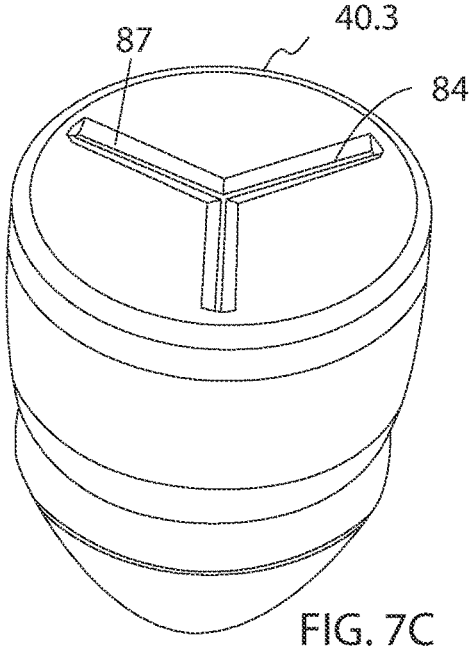
FIG. 7C is a perspective view of a forward component with a non-spin feature on the rearward facing end.
Figure 7E:
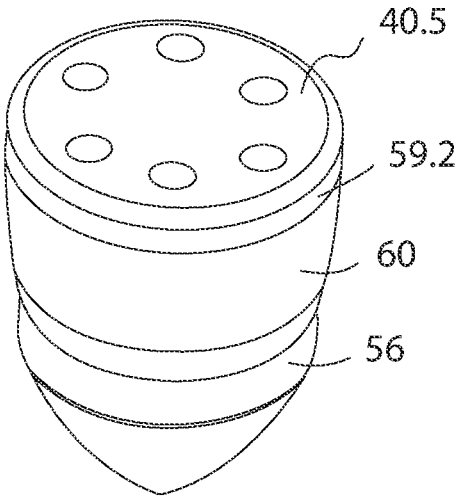
FIG. 7E is a perspective view of a forward component with a plurality of divots providing the non-spin feature on the rearward facing end of a forward component.
Figure 7F:
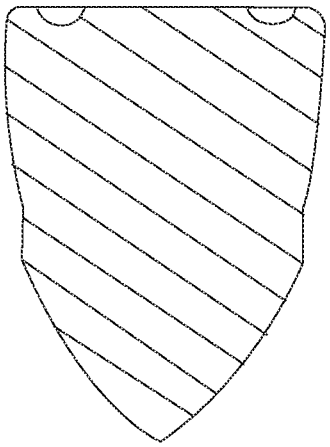
FIG. 7F is a cross-sectional view of a forward component with a plurality of divots providing the non-spin feature on the rearward facing end of a forward component.
Figure 7G:
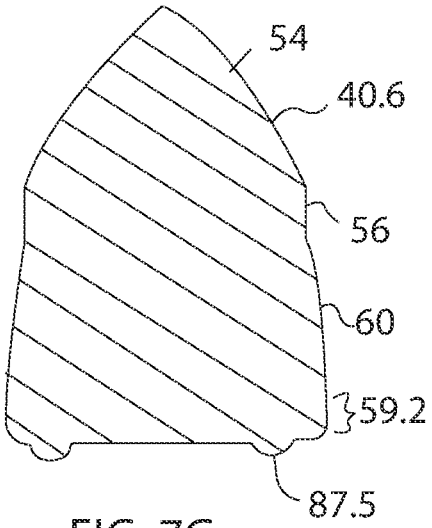
FIG. 7G is a cross-sectional view of a forward component with a plurality of divots providing the non-spin feature on the rearward facing end of a forward component.
Figure 7H:
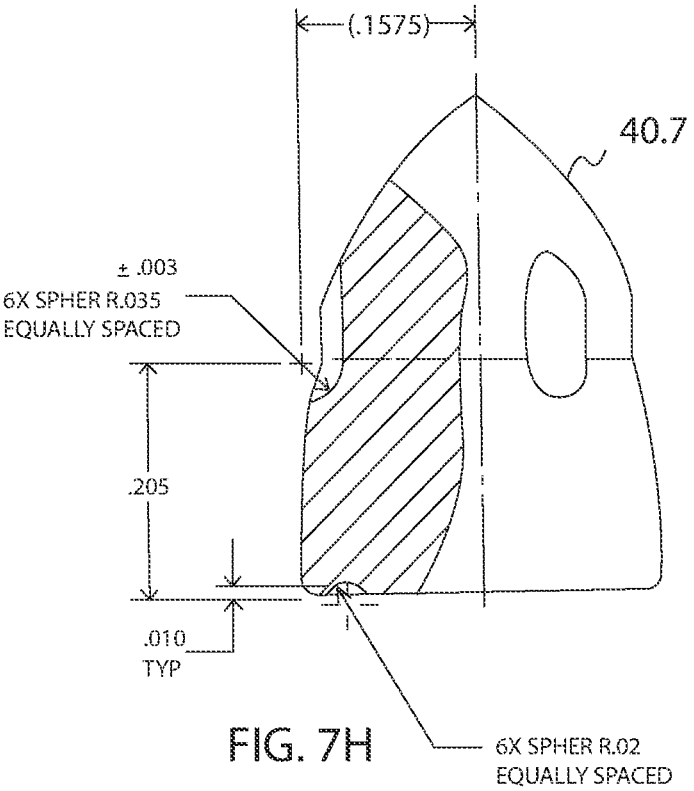
FIG. 7H is a cross-sectional view of a forward component with a plurality of forward flutes and a plurality of divots providing the non-spin feature on the rearward facing end of a forward component.

Referring to FIGS. 4A-4B, 9A-9D, steps suitable for manufacturing the bullets described herein are illustrated. A jacket preform 68 is inserted into a die 90. A lead ball 66 is inserted into the jacket. A steel forward component 40 is held by a suitable tool 92 to punch down onto the ball in the jacket deforming the ball and deforming the rearward face of the jacket. The combined steel component, lead core, and jacket 94 are then removed and inserted steel component end first into a skiving die, and then a finishing die 96 to obtain the final bullet shape. Other and additional steps may, of course, be utilized. During this process, the features on the rearward facing end surface of the steel component, as illustrated in FIGS. 7A-7C, will be readily imparted in the forward facing surface 99 of the lead core which was the lead ball before deformation. In another embodiment of the invention, this would also occur in a bullet configuration with a jacket and a copper core in the jacket rather than the lead core.

Figure 10:
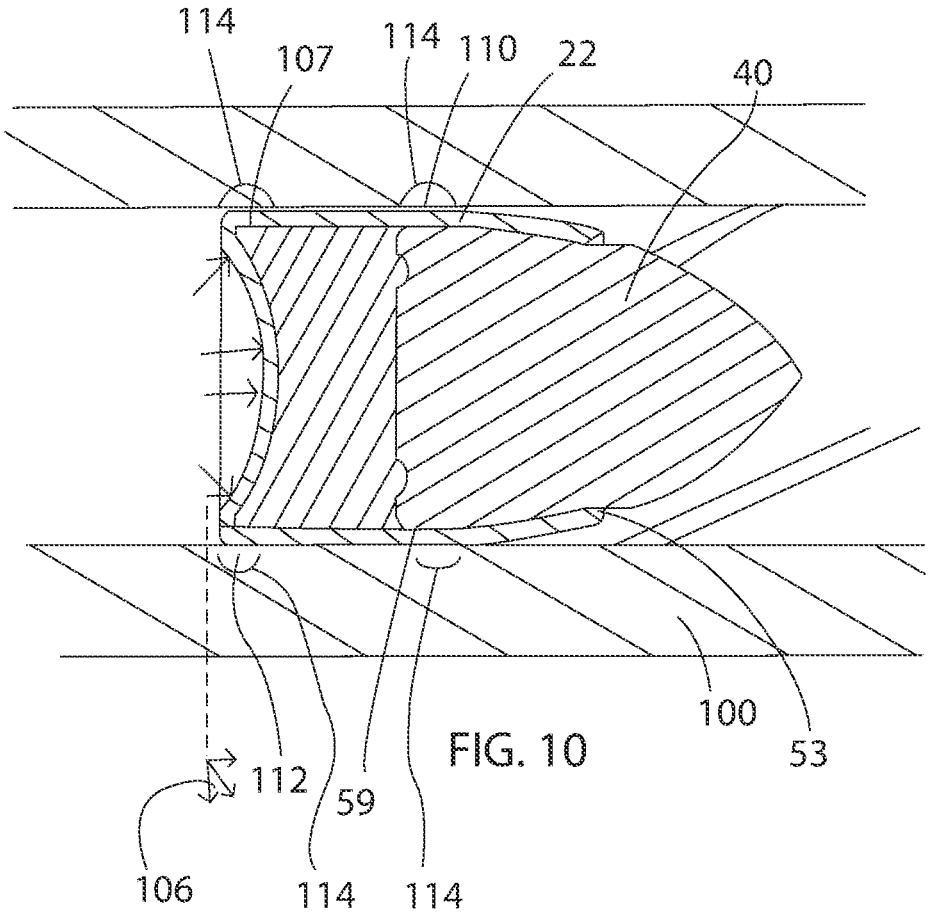
FIG. 10 is a cross-sectional view of a bullet according to embodiments of the invention traveling down a rifled barrel of a handgun.

Referring to FIG. 10, a bullet according to embodiments of the invention traveling down a barrel 100 is illustrated. The concavity 48 allows the forces from the ignition of the propellant to present a radial component 106 at the rear end of the bullet that pushes against the barrel providing a radial expansion of the rear end 107 of the bullet resulting in a gas seal. Also, the maximum diameter cylindrical end portion 59.2 of the steel component 40 is minimally deformable and provides a "hard" ring of contact 110 with the barrel. The radial expansion at the rear end provides another ring of contact 112 is believed to minimize yaw as the bullet travels down the barrel. When viewed in cross-section, this provides four principle regions of engagement 114 of the bullet with the rifled barrel, resulting in very stable bullet trajectory traveling down the barrel and toward the target. It has been observed that performance of steel component bullets with the concavity compared to steel component bullets with a flat rearward surface provides a significant increase in bullet accuracy.

In embodiments of the invention, the lead core can weigh about 1.4 to 2.2 times the weight of the jacket. The steel component can weigh 1.3 to 2.4 times the weight of the lead core. Weight may be approximately (within 20%) of the following for a 9 mm bullet:

Jacket=19.3 grains
Lead Core=36.2 grains
Steel Component=47.5

Figure 7I:
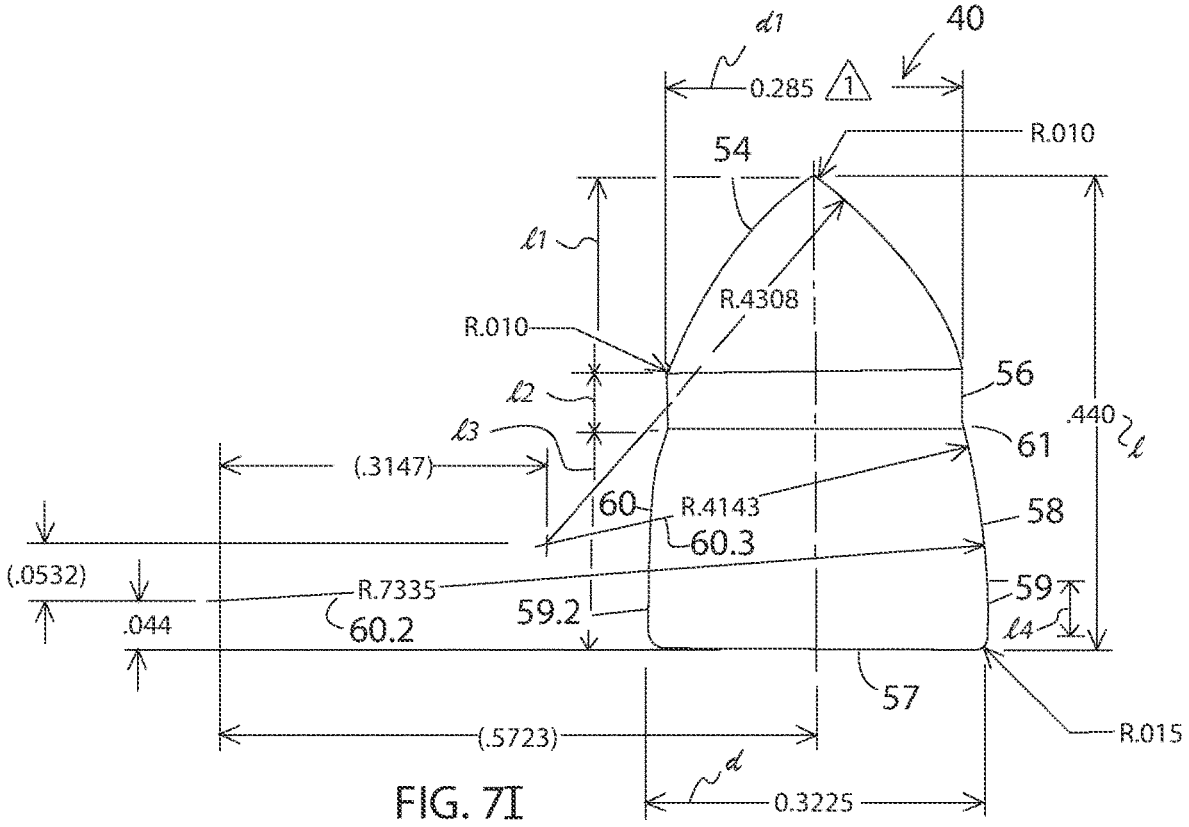
FIG. 7I is a side elevational view of a forward component with suitable dimensions.
Figure 8:
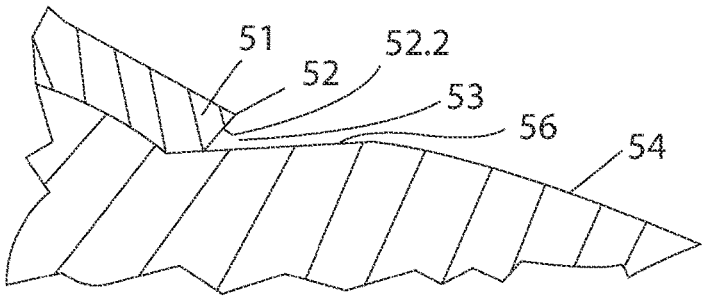
FIG. 8 is cross-sectional detail view of the jacket front edge engaging the cylindrical end portion of the forward component according to embodiments.
Figure 9A:
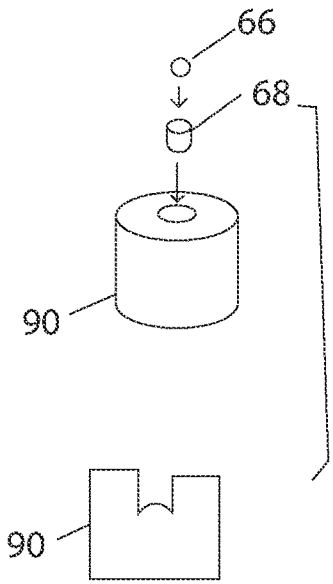
FIG. 9A is an illustration of a step in the process of manufacturing a bullet according to embodiments of the invention.
Figure 9B:
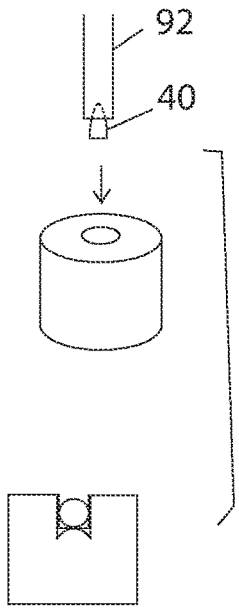
FIG. 9B is an illustration of another step in the process of manufacturing a bullet according to embodiments of the invention.
Figure 9C:
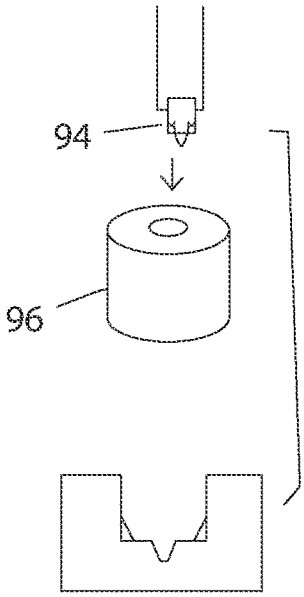
FIG. 9C is an illustration of another step in the process of manufacturing a bullet according to embodiments of the invention.
Figure 9D:
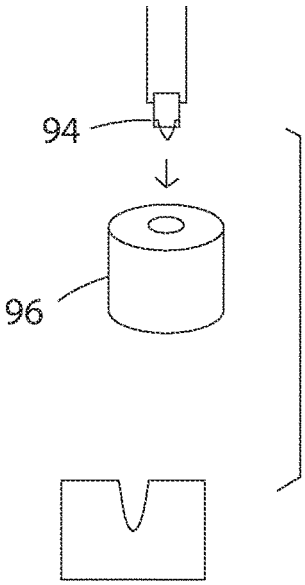
FIG. 9D is an illustration of a bullet, according to embodiments of the invention, traveling down a barrel.

Referring to FIG. 7I, suitable dimensions for the forward component are provided. In embodiments, the dimensions may vary within 10% of the given dimensions. For different sized bullets and cartridges, the dimensions will vary proportionally. The bullets herein may also be formed of other materials other than those specifically.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A cartridge, comprising:

a cartridge casing comprising an open mouth and an interior;

propellant in the interior of the cartridge casing; and a bullet secured in the mouth of the cartridge casing, the bullet comprising:

a jacket defining a cup comprising a leading edge;

a core component seated within the cup and comprising at least one rotation inhibiting feature;

a forward component seated in the cup forwardly of the core component and comprising at least one complementary rotation inhibiting feature that interfaces with the at least one rotation inhibiting feature, and is configured to inhibit the forward component rotating with respect to the core component; and a recess formed by the leading edge and the forward component defining a circumferential scoop.

2. The cartridge of claim 1, wherein the at least one rotation inhibiting feature is selected from at least one of: an outwardly projecting rib, an inwardly projecting rib, an outwardly projecting nub, an inwardly projecting nub, an outwardly projecting partial sphere, and an inwardly projecting partial sphere.

3. The cartridge of claim 1, wherein the at least one rotation inhibiting feature is selected from at least one of: a protruding structure that corresponds to an inverse of such shape and a recessed structure that corresponds to an inverse of such shape.

4. The cartridge of claim 1, wherein the at least one rotation inhibiting feature is selected from at least one of: a projection, an indentation, a recess, and a segmented recess.

5. The cartridge of claim 1, wherein the at least one rotation inhibiting feature includes a central pad configured to axially align a plurality of stacked bullets.

6. The cartridge of claim 5, wherein the central pad is at least one of: an outwardly projecting central pad and an inwardly projecting central pad.

7. The cartridge of claim 1, wherein the jacket comprises a leading edge positioned at the forward component, the leading edge comprising a reverse taper such that the leading edge is separated from the forward component and has a greater diameter than the forward component.

8. A bullet, comprising:

a jacket defining a cup comprising a leading edge;

a core component seated within the cup and comprising at least one rotation inhibiting feature; and a forward component seated in the cup forwardly of the core component and comprising at least one complementary rotation inhibiting feature that interfaces with the at least one rotation inhibiting feature, and is configured to inhibit the forward component rotating with respect to the core component; and a recess formed by the leading edge and the forward component defining a circumferential scoop.

9. The bullet of claim 8, wherein the at least one rotation inhibiting feature is selected from at least one of: an outwardly projecting rib, an inwardly projecting rib, an outwardly projecting nub, an inwardly projecting nub, an outwardly projecting partial sphere, and an inwardly projecting partial sphere.

10. The bullet of claim 8, wherein the at least one rotation inhibiting feature is selected from at least one of: a protruding structure that corresponds to an inverse of such shape and a recessed structure that corresponds to an inverse of such shape.

11. The bullet of claim 8, wherein the at least one rotation inhibiting feature is selected from at least one of: a projection, an indentation, a recess, and a segmented recess.

12. The bullet of claim 8, wherein the at least one rotation inhibiting feature includes a central pad configured to axially align a plurality of stacked bullets.

13. The bullet of claim 12, wherein the central pad is at least one of: an outwardly projecting central pad and an inwardly projecting central pad.

14. The bullet of claim 8, wherein the jacket comprises a leading edge positioned at the forward component, the leading edge comprising a reverse taper such that the leading edge is separated from the forward component and has a greater diameter than the forward component.

15. A method of manufacturing a bullet, comprising:

obtaining a jacket defining a cup and comprising a leading edge;

inserting, within the cup, a core component;

pressing, into the cup, forwardly of the core component, a forward component comprising at least one rotation inhibiting feature, wherein the at least one rotation inhibiting feature impacts the core component thereby creating at least one complementary rotation inhibiting feature; and forming a circumferential scoop between the leading edge and the forward component.

16. The method of claim 15, wherein the at least one rotation inhibiting feature is selected from at least one of: an outwardly projecting rib, an inwardly projecting rib, an outwardly projecting nub, an inwardly projecting nub, an outwardly projecting partial sphere, and an inwardly projecting partial sphere.

17. The method of claim 15, wherein the at least one rotation inhibiting feature is selected from at least one of: a protruding structure that corresponds to an inverse of such shape and a recessed structure that corresponds to an inverse of such shape.

18. The method of claim 15, wherein the at least one rotation inhibiting feature is selected from at least one of: a projection, an indentation, a recess, and a segmented recess.

19. The method of claim 15, wherein the at least one rotation inhibiting feature includes a central pad configured to axially align a plurality of stacked bullets.

20. The method of claim 19, wherein the central pad is at least one of: an outwardly projecting central pad and an inwardly projecting central pad.

* * * * *